United States Patent [19]

Millerburg

[11] 4,449,801

[45] May 22, 1984

[54] METHOD AND PROJECTING TYPOSITOR FOR COMPOSING TYPOGRAPHICAL ARTWORK ON COLOR SENSITIVE PHOTOGRAPHIC MEDIUM

[76] Inventor: John W. Millerburg, 2057 Castilian Dr., Hollywood, Calif. 90068

[21] Appl. No.: 380,782

[22] Filed: May 21, 1982

[51] Int. Cl.[3] ..... B41B 13/00

[52] U.S. Cl. ..... 354/12; 364/523

[58] Field of Search ..... 354/7, 12–16, 354/292; 352/87; 355/39, 40, 53, 77; 364/523

[56] References Cited

U.S. PATENT DOCUMENTS

| | | | |
|---|---|---|---|
| 3,330,191 | 7/1967 | King et al. | 354/7 |
| 3,626,460 | 12/1971 | Miller | 354/14 |
| 3,817,609 | 6/1974 | Vaughn | 352/87 |
| 3,968,501 | 7/1976 | Gilbert | 354/7 |

FOREIGN PATENT DOCUMENTS

| | | | |
|---|---|---|---|
| 584489 | 10/1959 | Canada | 354/12 |

*Primary Examiner*—William B. Perkey

*Attorney, Agent, or Firm*—William H. Pavitt, Jr.

[57] ABSTRACT

The present invention improves over the prior art by providing a method and apparatus for composing typographical artwork on color sensitive photographic medium, which method and apparatus may be of an automated nature. The apparatus comprises an optical projector, a number of type characters recorded on a projection medium, such as a strip of film, for projection by the optical projector onto a projection plane, such as a table surface, and may include an encasing light-tight hood. The identity (e.g. the location on the inventory film strip) of the letters selected to make up the sequence of images projected onto the table surface is recorded and stored in a storage memory together with information indicative of the position of the projected images of each of the selected letters along the two orthogonal axes of movement of the table surface. A servo-mechanism is provided for automatically repeating the projection of the selected typographical characters as recorded in the storage memory at the precise locations recorded for each of the selected letters.

14 Claims, 4 Drawing Figures

34
50
80
20
44
45
10
12
28
30
38
36
68
33
54
70
32
52
66
70
14
56
62
64
56

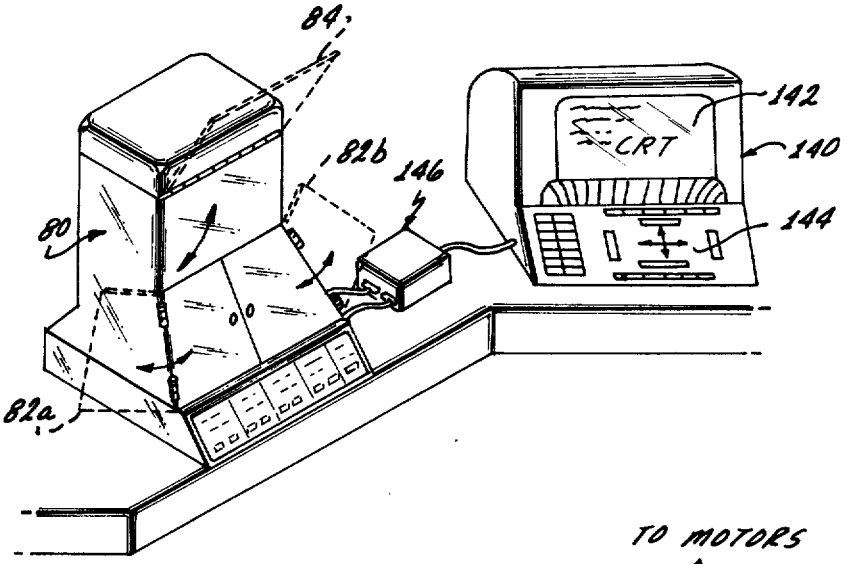
Fig. 4
Fig. 3
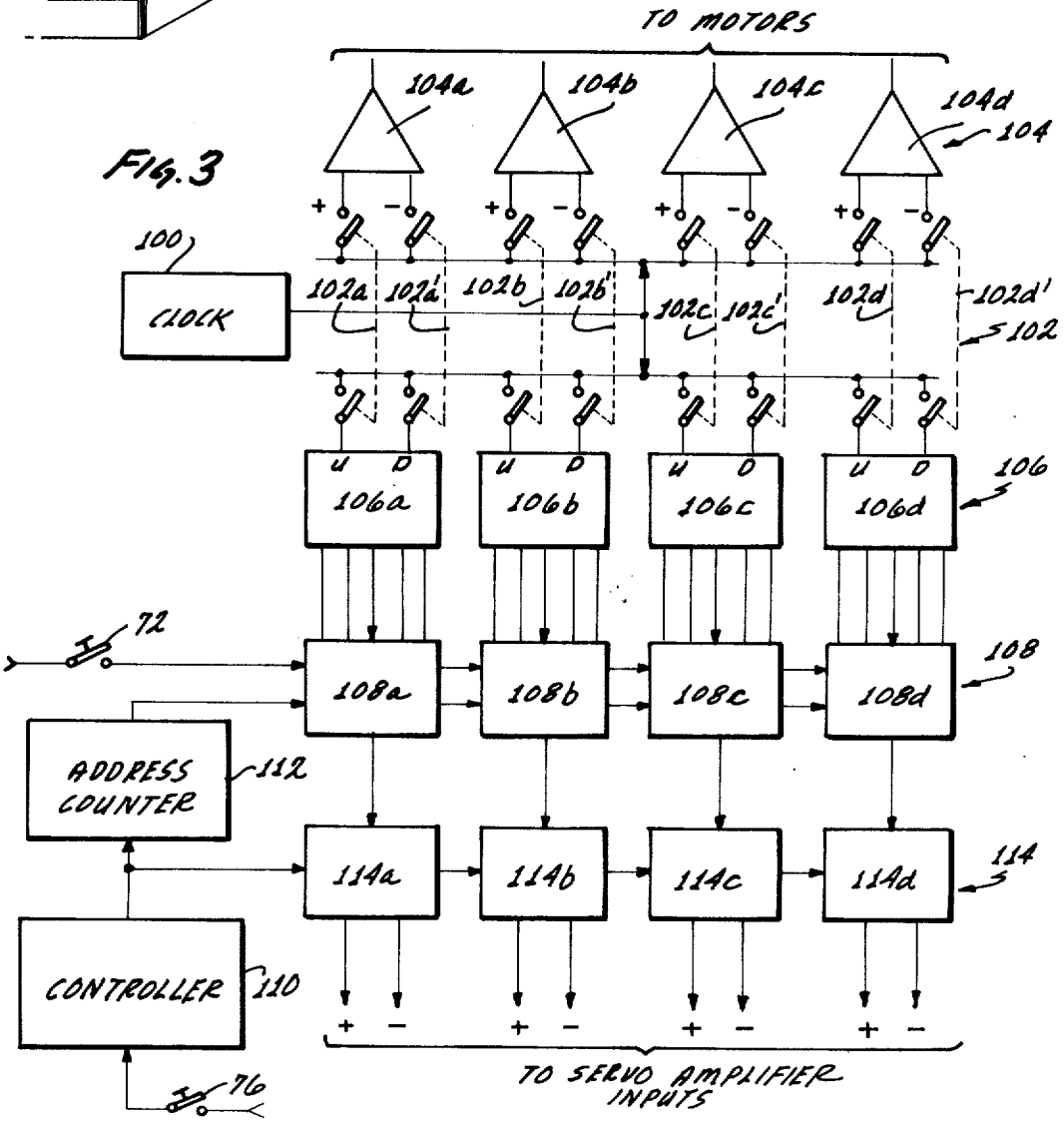

METHOD AND PROJECTING TYPOSITOR FOR COMPOSING TYPOGRAPHICAL ARTWORK ON COLOR SENSITIVE PHOTOGRAPHIC MEDIUM

BACKGROUND OF THE INVENTION

1. Field of the Invention

The present invention pertains to the field of automated typesetting and more particularly relates to a method and apparatus for composing typographical artwork on color sensitive photographic medium.

2. State of the Prior Art

Ornamental fonts, that is, artistically rendered lettering, is presently used in a variety of print and visual media. For example, advertising copy, titles and headings in magazines, television station logos, motion picture titles and credits are just a few of the many uses for ornamental fonts. A wide variety of font designs exist, each design giving rise to an entire alphabet based on a common motif or appearance. The font may have a three dimensional appearance, including beveled edges and drop shadows. The letters may be rendered so as to impart the appearance of metallic reflections, of a chromed surface, color, light and shadow effects and an almost infinite number of combinations and variations, limited only by the artist's creativity and skill. Each character is individually rendered by an artist by elaborate and time consuming processes, onto a sheet of transparency film to create the desired composition. This procedure is tedious and makes such artistic typographical work very expensive as well as time consuming.

Where the typographical composition is to be of a monochrome nature, it is possible to use more economical photographic methods for preparing the typographical layout. The individual type characters may be stored, as for example, on photographic film and projected one by one onto a single sheet of photosensitive material. The letters are positioned on the photographic sheet so as to compose the desired layout. The composition is carried out visually by an operator who selects the individual characters and projects their images onto the desired location on the photographic sheet so as to compose the layout. This kind of photocomposition is possible for monochrome material because the photographic emulsion is relatively insensitive to selected wave lengths of radiation. Thus, it is possible to visually create a composition under red light, known as a "safe light," without exposing the monochrome photographic sheet. The images of the characters may be projected through a safe light filter onto the photographic material, such that their position and appearance are visible to the operator, but without exposing the photosensitive emulsion.

It is presently accepted in the industry that photocomposition of colored typographical artwork is not possible because color sensitive photographic material is sensitive to all wave lengths of visible radiation and such composition, therefore, cannot be carried out under a safe light by the aforementioned visual method. As a result, it is presently necessary to resort to the aforedescribed cut and paste methods of composing the typographic layouts.

There are, however, known optical and photographic devices which, due to their inherent flexibility and ability to be programmed to operate in various desired modes, could be adapted to operate in the manner disclosed herein. These devices include motion control animation cameras which are operated by servo-mechanisms under computer control. These devices are normally used to take multiple image photographs of objects placed on a movable table under a servo controlled camera. Such an animation stand with rotoscope capabilities could be adapted to perform the method disclosed herein by using the camera to project images onto the movable table and properly programming the computer. However no such use of these animation stands has heretofore been attempted, and such application is unknown in the industry. The scope of the present invention, therefore, extends to the use of existing animation stands and similar equipment which may be programmed to perform the novel process disclosed by this specification.

SUMMARY OF THE INVENTION

The present invention improves over the prior art by providing a method and apparatus for composing typographical artwork on color sensitive photographic medium, which method and apparatus may be of an automated nature.

The invented apparatus comprises an optical projector, a number of type characters recorded on a projection medium, such as a strip of film, for projection by the optical projector onto a projection plane, and may include an encasing light-tight hood. The optical projector is further provided with means for selecting particular characters from an inventory of characters recorded on a storage medium, such as a film strip, by means of a film transport mechanism. The projection plane is preferably a table surface movable along two orthogonal axes perpendicular to the optical axis of the projector such that, by moving the table surface relative to the satisfactory optical projector, the projected image of a selected letter may be positioned at any arbitrarily selected location on the table surface and at any desired spacing from other letters previously or subsequently also projected onto the table surface. The identity (e.g., the location on the inventory film strip) of the letters selected to make up the sequence of images projected onto the table surface is recorded and stored in a storage memory together with information indicative of the position of the projected images of each of the selected letters along the two or orthogonal axes of movement of the table surface. A servo-mechanism is provided for automatically repeating the projection of the selected typographical characters as recorded in the storage memory at the precise locations recorded for each of the selected letters. It is thus possible to initially compose a typographical layout under operator control on monochrome photographic material placed on the table surface, and to subsequently automatically duplicate the composed typographical layout on a photosensitive material, such as color sensitive transparency material, in complete darkness or other controlled illumination conditions tolerated by the color sensitive material which is substituted for the monochrome material.

The optical projector may be mounted so as to be adjustable in elevation relative to the projection surface, thereby to permit variation of the size of the projected images. The storage memory may be also connected for recording and storing the adjustment of the projector elevation for each projected image during the composition process, and the servo-mechanism may thus also include means for bringing the projector automatically to the recorded elevation adjustment during the subsequent automatic repetition of the composed layout.

The invention also comprises a method for composing a typographical layout on a color sensitive photographic medium. In general, the method is practiced by projecting the image of a selected letter or type element onto a projection surface, and positioning the projected image at a selected location on the projection surface. The identity and position of the projected image are recorded and stored. Additional images are projected and positioned to compose a complete typographical layout, while recording the identity and position of each projected image. A color sensitive photographic material may then be placed on the projection surface which, by means of an encasing hood, will be in complete darkness or under otherwise controlled illumination which will not expose the color sensitive material, but which, in any event, would be unsuitable for easy visual composition of the layout by an operator. The previously composed and recorded layout is then duplicated on the color sensitive photographic material by means of suitable servo-mechanisms connected to the recording and storage means in which are stored the identities and positions of the characters making up the typographical layout.

The method and apparatus of the invention greatly accelerate the rendition of colored artistic typographical compositions while, at the same time, substantially reducing the cost of such compositions. A great deal of the time-consuming manual effort presently required is eliminated by this invention without, in any way, diminishing the artistic contribution of the operator who retains full control over the selection of font, size, spacing and layout of the characters.

BRIEF DESCRIPTION OF THE DRAWINGS

FIG. 3 is a block diagram of one possible embodiment of the storage and servo-control circuit for automatically duplicating a composition.

FIG. 4 is a perspective view of a typical projecting typositor work station incorporating the present invention.

DETAILED DESCRIPTION OF A PREFERRED EMBODIMENT OF THE INVENTION

Figure 1:
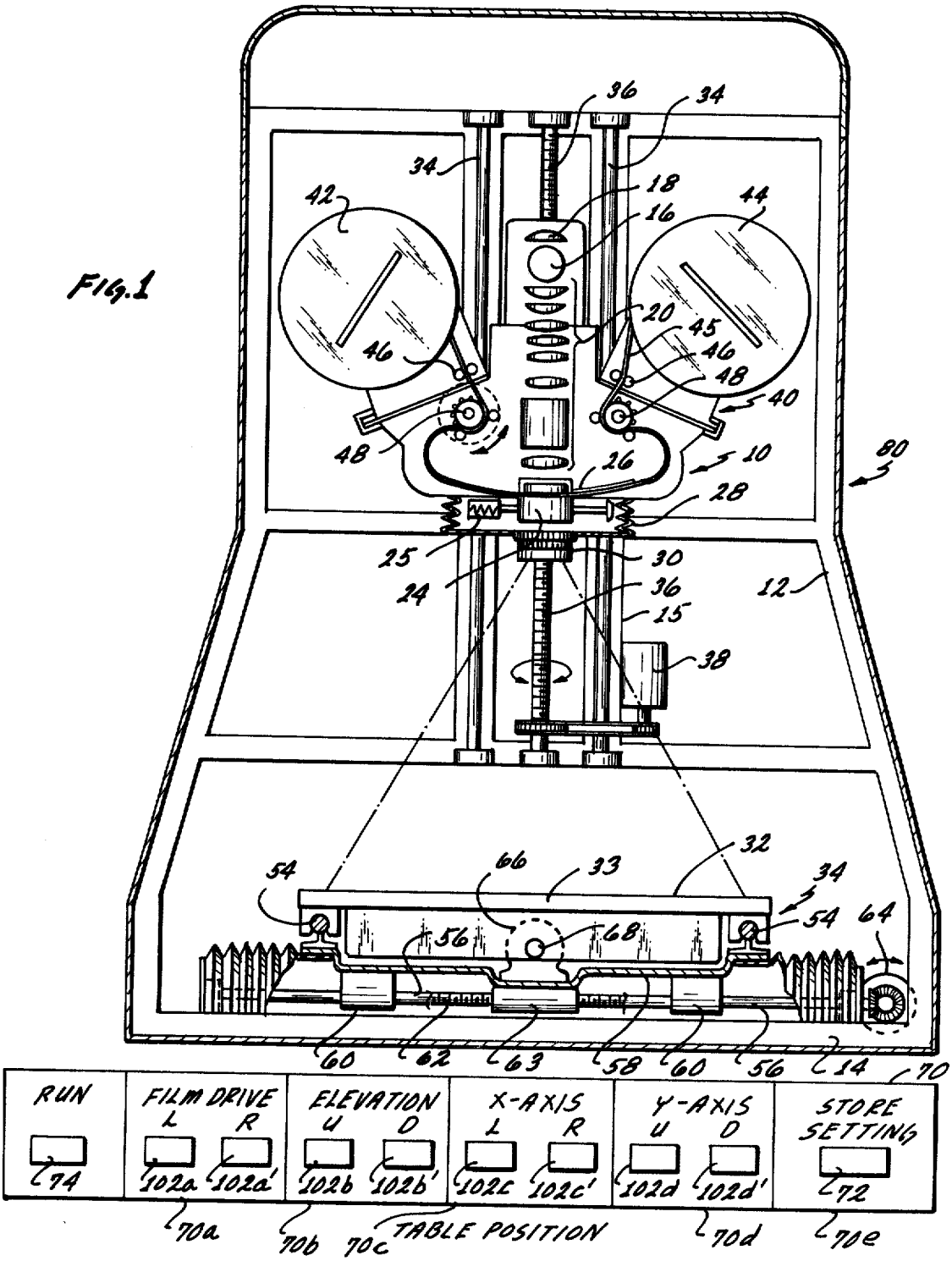
FIG. 1 is a front elevational view partly in section, showing the servo controlled projector and movable table, and a control panel for making the typographical composition.

With reference to the drawings and particularly FIG. 1 thereof, the apparatus of the invention comprises an optical projector or enlarger 10, and a supporting frame 12 connected to a base 14 so as to stably support the projector. The projector 10 includes a light source 16, a reflector 18 mounted above the light source for reflecting light along the optical axis of the projector and a condenser assembly 20. An adjustable diaphragm 24 is mounted to the projector body and includes an apertured film holder 26 on which may be positioned a photographic filmstrip for projection. The optical complement of the projector 10 is completed by a projector lense 26 movably mounted to the front of an extensible bellows 28. The distance between the projector lense 30 and the plane of the film holder 26 is adjustable for bringing the projected image into focus on a projection plane 32.

The projector 10 is preferably mounted on vertical parallel rails 34 such that it can be adjusted in elevation relative to the projection surface 32. The adjustment may be carried out by means of a rotatable threaded shaft 36 which engages a corresponding threaded bore in the rear of the projector body. Thus, the projector may be raised or lowered by rotating the shaft 36, for example, clockwise or counterclockwise, respectively. Desirably, the projector lense 30 is equipped with an auto-focus device of conventional design and known in the art for maintaining the projector lense in focus on the projection surface 32 as the projector is raised or lowered on the rails 34.

Figure 2:
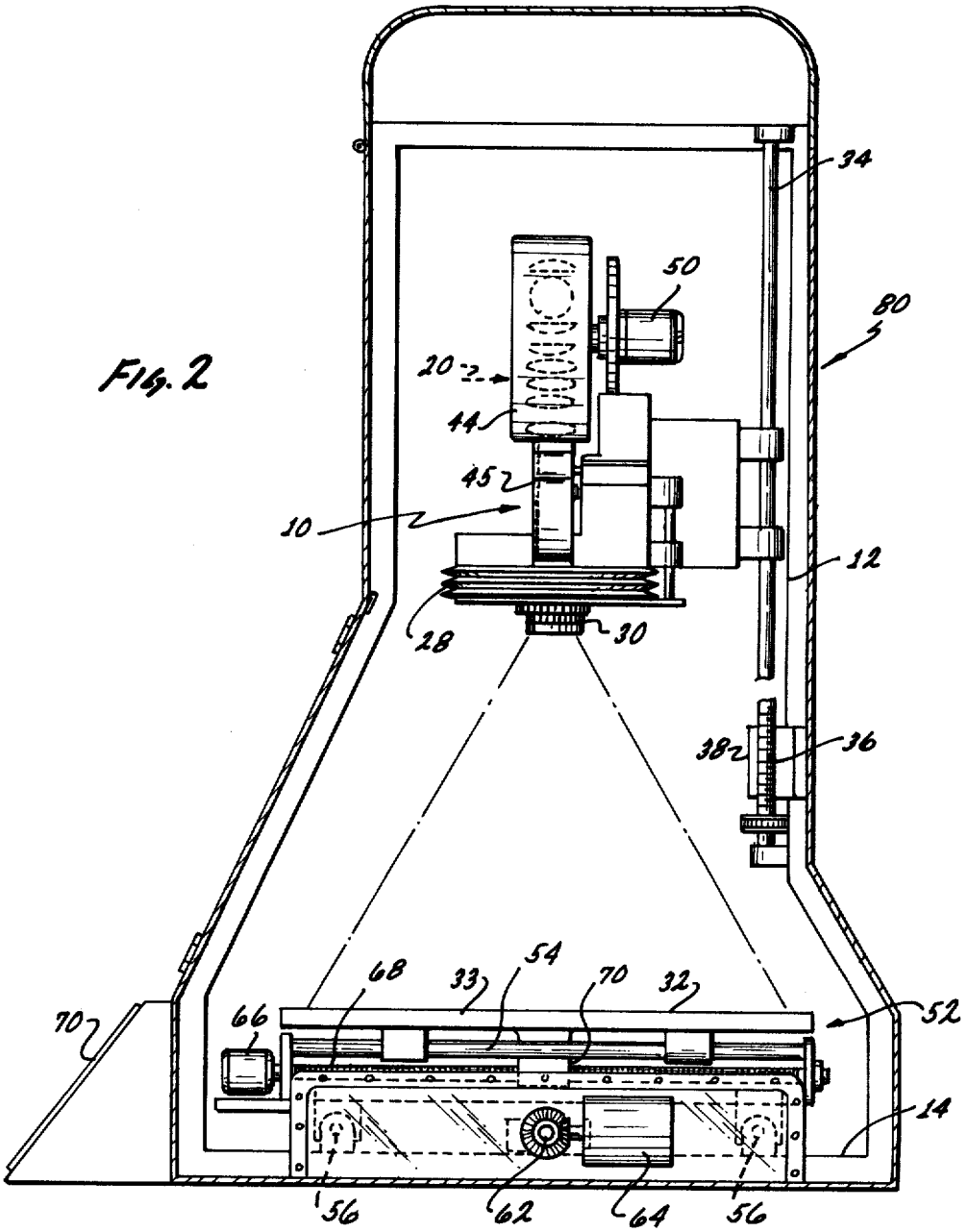
FIG. 2 is a side elevational view of the servo-controlled projection apparatus of FIG. 1.

The optical projector 10 is further provided with a film transport mechanism 40 which includes a left-hand reel 42, right-hand reel 44, film guide rollers 46 and a pair of sprocket mechanisms 48. A strip of film may be threaded through the rollers and sprocket mechanisms such that it passes through the film holder 26 between the two reels 42 and 44. As best shown in FIG. 2, each of the reels 42 and 44 is driven by a motor 50 which is preferably a stepper motor of the kind which advances in discrete steps or increments of rotation and is reversible or bi-directional. Two such motors are preferably provided although only one is visible in the side view of FIG. 2. At any given time, one of the motors operates as a supply motor and the other one works as a take-up motor, depending on the direction of movement of the filmstrip, such that a selected frame on the strip may be brought into position on the film holder 26 for projection onto the projection surfaces 32. There are film transport mechanisms known to the art which are suitable for use in the present invention with apropiate modification for the servo control requirements described below. Exemplary of such availabe transports are the Mitchel film transport with pin registration in which the pins move with the film, or the fixed pin registration transport in which the film is sandwiched through a gate which is raised during film movement and is lowered onto a set of fixed pins when the film transport is stoped. A movable table 52 is mounted underneath the projector 10 and is mounted on rails 54 and 56 which permit the table and the projection surface 32 defined thereby to be moved along two orthogonal axes corresponding to the two sets of parallel rails 54 and 56 respectively.

The movable table assembly 52 is provided with a pair of servomotors 64, 66 mounted for independently rotating orthogonal threaded shafts to thereby bring about displacement of the table along the orthogonal axes defined by the perpendicular pairs of rails 54 and 56. The table assembly includes a carriage 58 which has downwardly extending lugs 60 bored for slidingly receiving the shafts 56 defining the x-axis of movement of the table. A first threaded shaft 62 is mounted intermediate the two rails 56. The threaded shaft 62 is supported at its ends to the base 14 of the apparatus frame and extends through a lug 64 extending downwardly from the lower carriage 58. The lug 64 is bored and threaded to mate with the threaded shaft 62 such that rotation of the shaft causes the lower carriage 58 to move along the rails 56. A first servomotor 64 is mounted to the base 14 and geared for rotating the threaded shaft 62. A second servomotor 66 in turn is mounted to the lower carriage 58 and rotates a second threaded shaft 68 which is supported at its ends to the lower carriage. The second threaded shaft 68 extends through a lug 70 affixed to the underside of the table 33.

The lug is bored and threaded to mate with the shaft 68 such that when the shaft is rotated by the servomotor 66, the table 33 is moved along a y-axis along the rails 54. In this manner, any point on the projection surface may be brought into position directly underneath the projection lense 30 such that images projected thereon may be positioned at arbitrarily selected locations on the projection surface.

The vertical threaded shaft 36 for adjusting the elevation of the projector 10 is desirably also driven by a servomotor 38 which may be mounted to a brace member 15 of the supporting frame 12. The servomotor 38 may be connected to the shaft 36 by means of a chain and sprocket arrangement or other suitable gearing.

In a presently preferred embodiment, all servomotors 50, 36, 64 and 66 are stepping motors of the type which rotate an output shaft in one direction or the other in precise incremental steps. Desirably, the stepping motors have a relatively high number of steps per revolution of the output shaft in order to enable accurate positioning of the various elements. It will be understood, however, that other types of motors may be used with the present invention provided that suitable control means are employed for reliably repositioning the various moving elements to previously recorded positions.

A control panel 70 which may be mounted to the front of the housing of the projector unit and may include controls for individually activating the servomotors in clockwise or counterclockwise rotation. Also provided may be a store control which is depressed by an operator for recording in a storage circuit the chosen settings of the various elements obtained by rotation of the various servomotors. Thus, in a typical sequence, the film drive motors 50 would be activated on control subpanel **70*a* to bring a desired letter or character into alignment with the optical axes of the projector on the film holder 26. The light source 26 having been previously activated, the image of the selected character is projected onto the surface 32. The elevation of the projector may then be adjusted by means of the controls on subpanel 70*b* to obtain a desired image size for the selected character. The projected image may then be arbitrarily positioned on the surface 32 of the table 33 by appropriate operation of the servomotors 64 and 66 by means of the controls of subpanels 70*c* and 70*d* respectively. Once the desired positioning of the projected image is obtained, as determined by visual inspection of the image on the projection surface, the settings of all servomotors 50, 38, 64 and 66 are recorded into a memory device by pressing a control, such as a store button 72, in subpanel 70*e***.

Persons skilled in the art will be able to design or make use of existing electronic circuits and devices to effect the storage of the recorded settings and to control the various servomotors in the aforedescribed manner in response to the two operator actuation of the controls on panel 70. The invention is, therefore, not limited to any particular control or memory devices or circuits, as such devices or circuits are known to those skilled in the art, or existing devices can be readily adapted for use with the present invention. It will be further understood that the layout and controls shown on the panel 70 are for purposes of general illustration only and may be changed in various ways without departing from the essence of the invention.

The block diagram shown in FIG. 3 of the drawings is only for purposes of understanding the operation of the projection apparatus and method of the invention, rather than for disclosure of a particular control circuit.

In FIG. 3, a system clock 100 has a pulse output connected to a bank of switches 102. Individual switches may be set for directing the pulse output of the clock to a selected input of one of a number of servoamplifiers 104. Four such servoamplifiers may be provided, **104*a*–104*d*, each having an output connected for stepping one of the servomotors 50, 38, 64 and 66. Each servoamplifier has a positive and a negative input such that by feeding clock pulses into one input, the corresponding servomotor is rotated in one direction while a clock input into the servoamplifier input of opposite polarity will cause opposite rotation of the servomotor. The switches 102 correspond to the switches on the control panel 70 of FIG. 1 such that by pressing the appropriate control switches, the various typositor elements are moved to desired positions for composing the typographical layout on the projection surface 32. Each of the servoamplifiers 104*a*–104*d* has associated with it an up-down digital counter 106*a*–106*d*, each provided with an up input and a down input corresponding to one of the inputs of the servoamplifier. Thus, the plus input to servoamplifier 104*a* may be associated with the up input of the counter 106*a* while the minus input of the servoamplifier may be associated with the down input of the counter. The control switches 102 may be gauged in pairs as suggested by the dotted lines such that the clock output is simultaneously connected to the desired servoamplifier input and also fed to the corresponding counter input. The switches are preferably set up so that only one of the switches in the switch bank 102** may be activated at any one time and that a clock input cannot be fed to more than one counter input at any given moment.

To initiate the composition process, the counters **106*a* through 106*d* are reset to zero and the appropriate switches on the control panel 70 are closed to search through the inventory film strip for a particular character, position its projected image on the table 33, etc. As pulses are fed into the servoamplifier corresponding to each switch being closed, a running total of the pulses is kept by the corresponding counter, each pulse corresponding to an incremental step in rotation of the corresponding servomotor. Both the number of steps and the direction of rotation is recorded by the counter in that rotation in a positive direction increases the total count of the counter while rotation in an opposite direction reduces the accumulated total count, or increases a negative count stored in the counter. When a particular character has been projected, enlarged to the desired size and correctly positioned on the table 33, the store switch 72 may be pressed. The store switch is connected so as to latch the total count of each of the counters in an associated storage device 108 which may be a digital memory circuit. Thus, digital information indicative of the net rotation of each of the servomotors from a beginning position and resultant position of the film strip, projector and table is stored in a corresponding memory space 108 through 108*d*, in the form of a count total. The process is continued by selecting a second typographical element from the character inventory filmstrip 45 and operating the servomotors 50 to bring the particular character into position on the film holder 26. If desired, the elevation of the projector 10 is adjusted by operation of the switches 102*b* and 102*b*′ which control the servomotor 38. The second character is then positioned by movement of the projection surface 32 along the two axes and when the proper settings have been attained, they are stored by again depressing the switch 72. This causes the new settings of the servomotors to be stored at a second memory address in each of the memory spaces 108 through 108***d*. The composition of the layout is continued in this manner with the servomotor settings corresponding to each typographical element being sequentially stored at successive memory addresses in the corresponding memory spaces.

When the typographical composition has been completed to the satisfaction of the operator, e.g., on monochrome photographic material, a sheet of color sensitive photographic material, such as color transparency film, may be placed on the projection surface 32 of the table 33. This is carried out under conditions of controlled illumination or in complete darkness so as not to expose the color sensitive photographic material by means of the hood 80. Once the transparency film has been placed on the projection surface, the hinged doors of the hood or other light-tight enclosure 80 may be shut so as to permit the room to be again illuminated for the convenience of the operator while the color sensitive film is protected against exposure by ambient illumination during the remainder of the process.

The typographical composition may then be automatically repeated and duplicated onto the color sensitive material by pressing switch 74 labeled "run" on the control panel 70. Closing the switch 74 activates a controller circuit 110 which takes over the operation of the servomotors. This is accomplished through an address counter 112 which is connected to the memory bank 108 in such a manner as to step each of the memory circuits 108*a*–108*d* through the addresses in which are stored the individual servomotor settings for each character. The stored settings are called out by the address counter 112 such that an output is obtained from each memory area 108*a* through 108*d*. The controller further controls a set of comparators 114. The comparators receive as an input the digital output of the corresponding memory area which is compared to a previous known position of the respective servomotors to produce a pulse output connected to the plus or minus input of the corresponding servoamplifiers 104*a*–104*d*, to rotate the servomotors to the position recalled from the memories 108*a* through 108*d*. One possible scheme for accomplishing this is to begin at a zero initial servomotor position (corresponding to some starting position for the film, projector and table) which is compared to the information stored in a first memory address. The motors are then brought to the positions indicated by the recalled information in the first memory address in each memory space 108*a*–108*d*. This information is also stored in the comparators 114 for comparison with information subsequently retrieved from a second sequential memory address in the respective memory spaces. The information of the second memory address is compared with the stored information of the first memory address and the comparators operate the servomotors in accordance with this difference to move the projector system elements to the positions indicated by the second memory address. The process is continued until the memory addresses have been exhausted. The selection, size and position of each typographical character is fully defined by a set of four memory addresses which includes one memory address in each of the four memory spaces 108*a*–108*d*.

The above described system may be supplemented by long-term memory storage, such as floppy disc drives or magnetic tape storage, so that the recorded servomotor position information for each complete typographical composition may be saved for future use on such magnetic storage media. The system may be further enhanced by a computer terminal, programmable or otherwise, on which previously recorded and stored compositions may be previewed, for example, on the CRT screen, and possibly edited prior to duplication on the color sensitive medium. If desired, the original composition of the layouts may be carried out on the terminal CRT screen rather than on the projection surface 32. Such an implementation of the present system would be operated substantially in the same manner as has been described in connection with the more basic embodiment of FIGS. 1–3. Particular characters would be called out from memory, each character being associated with a location on the filmstrip 45 in the projector transport mechanism 40. Although the characters viewed on the CRT screen would be stored in the electronic memory of the terminal, they, nonetheless, would be associated with photographically stored characters on a filmstrip 45 in the projector. The difference being that during initial composition, the filmstrip is not driven through the transport, nor does actual projection of the images take place. As the layout is composed on the CRT screen, however, the various parameters corresponding to the identity of the characters, desired image size, and location on the projection surface 32 may be generated electronically by the terminal and retained for automatic duplication through the projector 10 onto a color sensitive photographic medium supported on the projection surface 32. A typical work station incorporating a CRT computer terminal 140 is illustrated in FIG. 4 of the drawings. The terminal 140 would typically include a CRT screen 142 and a keyboard 144 which would include, at a minimum, controls equivalent to those shown on the control panel 70 in FIG. 1. The terminal 140 is shown to be operatively interconnected to the projector unit by means of an interface 146.

The projector unit is shown in FIG. 4 enclosed in a light-tight housing or hood 80 which may be formed of thin synthetic material or sheet metal fastened to and supported by the frame 12, as illustrated in FIGS. 1 and 2. The front of the housing or hood 80 may comprise hinged portions 82*a* and 82*b* as well as an upper hinged portion 84 for gaining access to the projection apparatus during initial visual composition of the layout. The hinged portions 82*a*, 82*b* may then be shut after the color sensitive material has been placed on the projection surface for automatic duplication of the composed layout.

It will be appreciated that a limiting factor in the speed of operation of the projection apparatus during automatic duplication of compositions is the time required to expose each individual character on the photographic material. This, in turn, is determined in part by the intensity of light available from the source 16. It is contemplated that the exposure time can be substantially reduced by the use of a high intensity strobe. The advantage of using strobe light sources is that the heat output of such strobes is very small compared to the heat generated by conventionally used light sources in projection apparatus. The heat generated in projectors is potentially damaging to the lenses of the projector. Although the lens itself is of glass and largely impervious to heat, the lenses are commonly mounted by means of compounds such as gum arabic which tends to bubble when subjected to intense heat. This problem is commonly solved by using specially built projection lenses in which the lens elements are brass mounted and, thus, not damaged by the heat. Brass mounted projecton lenses, however, are costly and are not available in as wide a range of optical characteristics as "taking" lenses. The "taking lenses," so-called because they are used on cameras for taking or recording images, are available in a wide range of apertures, focal lengths, etc., and are thus desirable for use in projection applications as well if the heat problem can be overcome.

Applicant is not aware of any present use of strobe lights in the projection of images and such use is believed to be novel in applicant's apparatus. A strobe is defined for purposes of the specification as a gas discharge or flash tube where a brief high intensity flash of light is obtained by discharging an electrical current through a gas filled tube between a pair of sealed electrodes.

The projector is shown provided with a safelight filter 25 mounted between the film holder 26 and the projection lense 30 such that the safelight filter may be interposed between the film and the projection lense to filter out light wavelengths which would expose monochrome photographic material placed on the projection surface 32. Such a safelight filter is presently used for composing typographical layouts by photographic methods on monochrome material. A character image is projected through the safelight filter onto the monochrome material on the table 33 so that an operator may see the image and position it without exposing the monochrome material. When the image has been properly positioned, the safelight filter is removed and an exposure made. The safelight filter is then replaced and the next character is selected, positioned, and exposed. This procedure is repeated until the layout has been completed.

While applicant's preferred embodiment of the invention has been illustrated and described, it will be apprciated by those skilled in the pertinent art that various changes substitutions and modifications may be made without departing from the spirit and scope of the invention.

What is claimed is:

1. A method of composing a typographical layout on a color sensitive photographic medium comprising the steps of:

projecting the image of a selected type character onto a projection surface;

positioning the projected image at a selected location on the projection surface;

repeating said projecting and positioning steps to visually compose a desired typographical layout;

recording the identity and position of each projected type character in the composed layout;

placing a color sensitive photographic material onto said projection surface; and duplicating the recorded composition on said color sensitive photographic material.

2. The method of claim 1 wherein said projecting step comprises the step of enlarging each projected image to a desired size.

3. The method of claim 1 further comprising the steps of printing each projected and positioned image on monochrome photographic material to obtain a monochrome version of a desired typographical material prior to placing the color sensitive photographic material.

4. The method of claim 1 wherein said duplicating step is carried out under controlled illumination not suitable for visual composition of the typographical layout.

5. The method of claim 1 wherein said color sensitive material is shielded against ambient illumination during said duplicating step.

6. The method of claim 1 wherein said step of projecting further comprises the step of selecting a particular character stored on a strip of photographic film.

7. The method of claim 1 further comprising the step of storing projectable colored images of a plurality of typographical characters on a strip of photographic material.

8. The method of claim 7 wherein said step of projecting further comprises the step of locating a particular image on said strip of photographic material.

9. The method of claim 8 wherein said step of recording the identity of each selected type character comprises the step of recording the location of the type character on the strip of photographic material.

10. The method of claim 8 or claim 9 wherein said step of locating a type character comprises the step of moving said strip of photographic material through an optical projector by means of a film transport.

11. The method of claim 2 wherein said step of enlarging comprises the step of adjusting the height of an optical projector relative to the projection surface.

12. The method of claim 1 wherein the step of recording the identity and position of each projected image comprises the step of counting the rotational steps performed from a known initial position by stepping motors associated with the image selection and position processes, and storing the counts.

13. The method of claim 2 wherein the step of duplicating the recorded composition comprises the step of stepping the stepping motors according to the stored count for each previously selected and positioned image.

14. A method for composing a typographical layout on a color sensitive photographic medium utilizing a projecting phototypositor including an optical projector, a film transport mechanism, and a projection surface movable in a plane perpendicular to the optical axes of the projector, said method comprising the steps of:

placing an inventory film containing a plurality of typographical characters in the tape transport of the optical projector;

operating the tape transport to select a desired typographical character for projection onto the table surface;

enlarging the projected image to a desired size by adjusting the elevation of the optical projector relative to the table surface;

moving the table to position the projected image at a desired location on the table surface;

recording the location of the selected character on the inventory filmstrip;

recording the positioning of the table for the particular character;

repeating the above steps for additional selected characters to visually compose a desired typographical layout;

placing a color sensitive photographic material onto the table surface; and duplicating the recorded typographical composition by operating the optical projector, the film transport and the movable table surface under control of the recorded information for each previously projected typographical character.

* * * * *